US006443855B1

(12) United States Patent
Tseng

(10) Patent No.: US 6,443,855 B1
(45) **Date of Patent: *Sep. 3, 2002**

(54) HEAD OF A GOLF CLUB

(76) Inventor: Wen-Cheng Tseng, No. 27, Kung-Chuan Rd., Tai-Shan Hsiang, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/450,974

(22) Filed: Nov. 30, 1999

(51) Int. Cl.[7] ..... A63B 53/04; A63B 53/06; A63B 53/08

(52) U.S. Cl. ..... 473/326; 473/326; 473/329; 473/333

(58) Field of Search ..... 473/326, 329, 473/345, 340, 330; 273/170, 167 H

(56) References Cited

U.S. PATENT DOCUMENTS 5,178,392 A * 1/1993 Santioni ..... 273/167 R
5,263,713 A * 11/1993 Taylor et al. ..... 273/78
5,788,587 A * 8/1998 Tseng ..... 473/326

* cited by examiner

*Primary Examiner*—Paul T. Sewell
*Assistant Examiner*—Sneh Varma
(74) *Attorney, Agent, or Firm*—Thorp Reed & Armstrong, LLP

(57) ABSTRACT

A head of golf club having a hollow body with a first semi-phere integrally formed therein and a filling line integrally formed between the first semi-sphere and the bottom of the body portion, a face welded on a front end the body, a float received between the first semi-sphere and a second semi-sphere which is combined with the first semi-sphere by welding, and a casing welded on a back end of the body portion, whereby the center of mass of the golf club is self-optimizing, and the structure of the golf club head is simple and firm.

2 Claims, 4 Drawing Sheets

HEAD OF A GOLF CLUB

BACKGROUND OF THE INVENTION

1. Field of the Invention

The present invention relates to an improved head of a golf club which is capable of self-optimizing its center of mass to increase precision and stability in the striking of a golf ball by the golf club.

2. Description of Related Art

Selection of golf clubs is a very important factor in golf. In order to improve precision and stability in the striking of a golf ball, various kinds of aids, such as a balancing instrument or a weight is provided at a head of a golf club to help a golfer.

The conventional golf club has a fixed center of mass, when the golf club is held at various angles, and the center of mass will not change, however a striking spot may move away from the center of mass. Particularly, when the center of mass is higher than the striking spot, a top striking mis-hit will occur, so that the golf ball will not fly as far as possible.

One type of golf club with a head which is capable of self-optimizing its center of mass is introduced from a U.S. Pat. No. 5,788,587 filed on Jul. 7, 1997 by the same applicant of the invention. This type of golf club has a special head which comprises a globe provided therein with a float received in the globe. The space between the float and the globe is filled with liquid. The globe is fixed in position by foam disposed between the head and the globe. As the float is far lighter than the liquid, the float always floats on a higher lever, and the liquid always goes lower, so that the center of mass of the golf club is changeable and always goes to a possible lowest possible point.

However, the above described golf club still has the following disadvantages:

1. the globe is fixed in the head of the golf club via a threaded post and a corresponding threaded hole defined in an inner wall of the head, so the production cost is high because of the complex structure;
2. the globe is further filled with foam which increases the cost; and
3. as the foam between the head and the globe will absorb sound waves, the golf club will not strike a ball with a preferred audible "crack."

Therefore, it is an objective of the invention to provide an improved head of a golf club to mitigate and/or obviate the aforementioned problems.

SUMMARY OF THE INVENTION

The main object of the present invention is to provided an improved head of a golf club, wherein the head is composed of a hollow body portion with a first semi-sphere integrally formed therein and a filling line integrally formed between the first semi-sphere and a bottom of the body portion, a face welded on a front end of the body portion, a float received in the first semi-sphere and a second semi-sphere welded with the first semi-sphere, and a casing welded on a back end of the body portion. A steel ball and a screw are provided in the filling line to seal the filling line after liquid is poured into a space between the float and the combined two semi-spheres.

Other objects, advantages and novel features of the invention will become more apparent from the following detailed description when taken in conjunction with the accompanying drawings.

DETAILED DESCRIPTION OF THE PREFERRED EMBODIMENT

Figure 1:
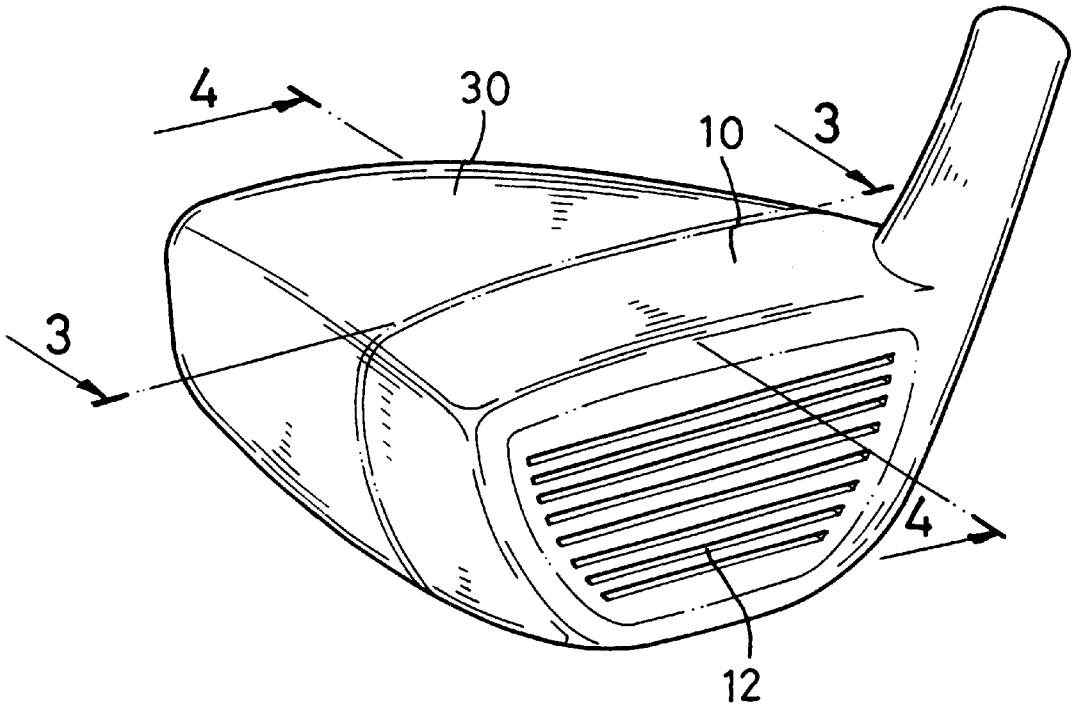
FIG. 1 is a perspective view of a head portion of a golf club in accordance with the invention.
Figure 2:
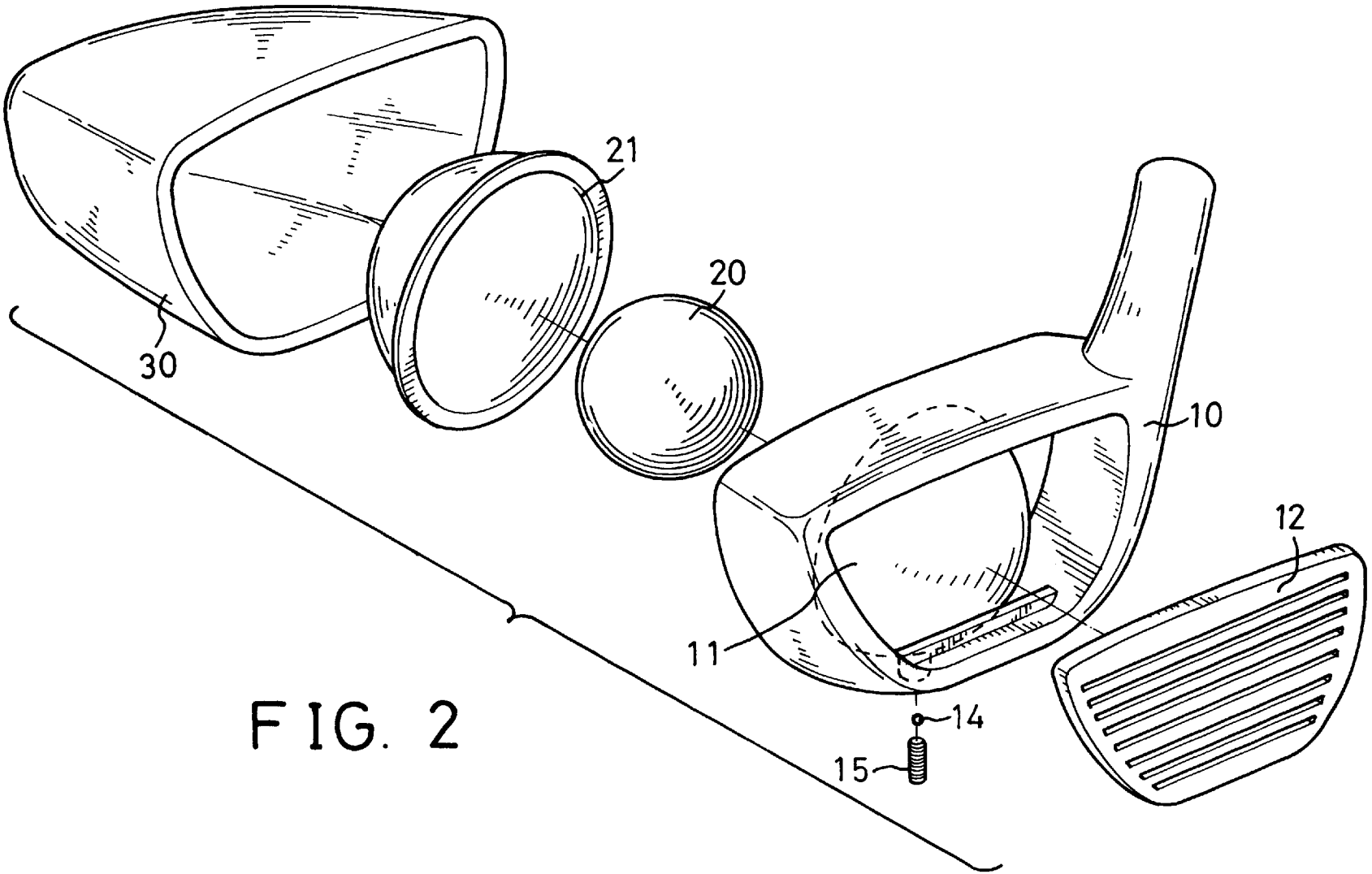
FIG. 2 is an exploded perspective view of the head portion of the golf club in accordance with the invention.

As shown in FIGS. 1 and 2, a head of a golf club in accordance with the present invention is composed of a hollow body (10) with a first semi-sphere (11) integrally formed therein and a face (12) welded on a front end of the body (10), a float (20) received between the first semi-sphere (11) and a second semi-sphere (21) which is welded to the first semi-sphere (11), and a casing (30) securely welded on a back end of the body (10).

Figure 3:
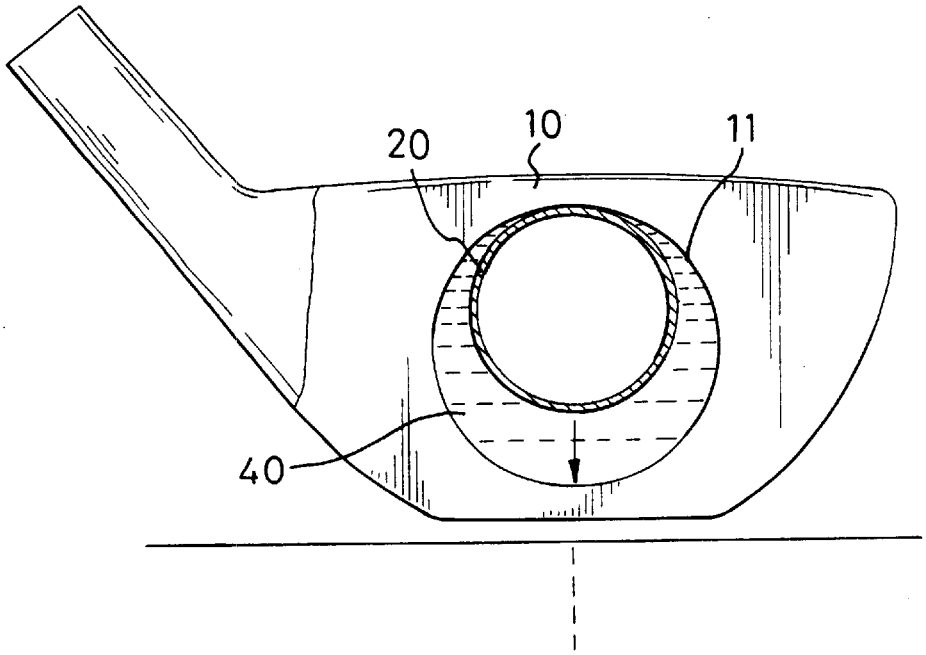
FIG. 3 is a sectional view of the head portion of the golf club shown in FIG. 1 along line 3—3.
Figure 4:
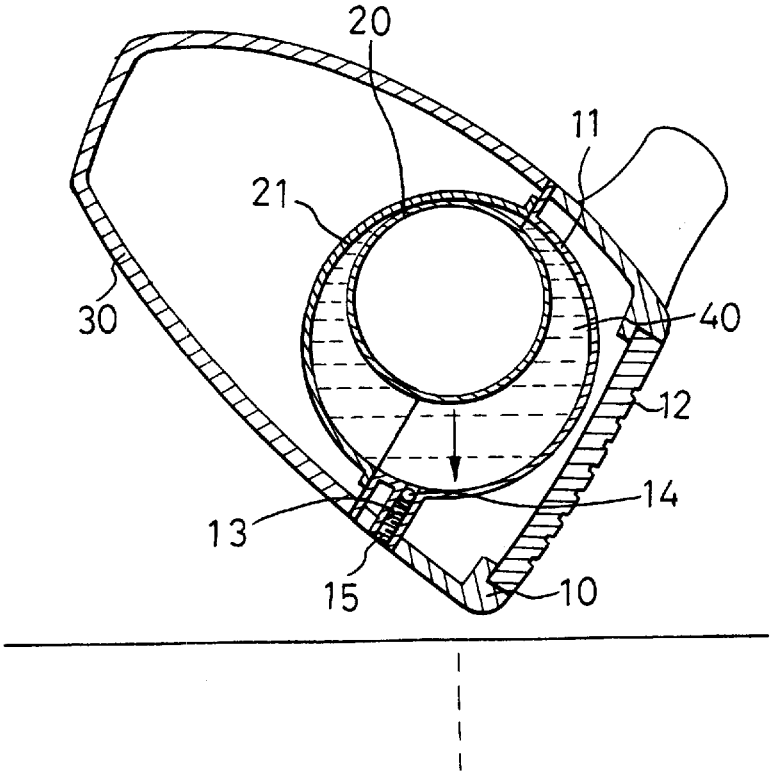
FIG. 4 is a cross sectional view of the assembled head portion of the golf club shown in a first inclination.
Figure 5:
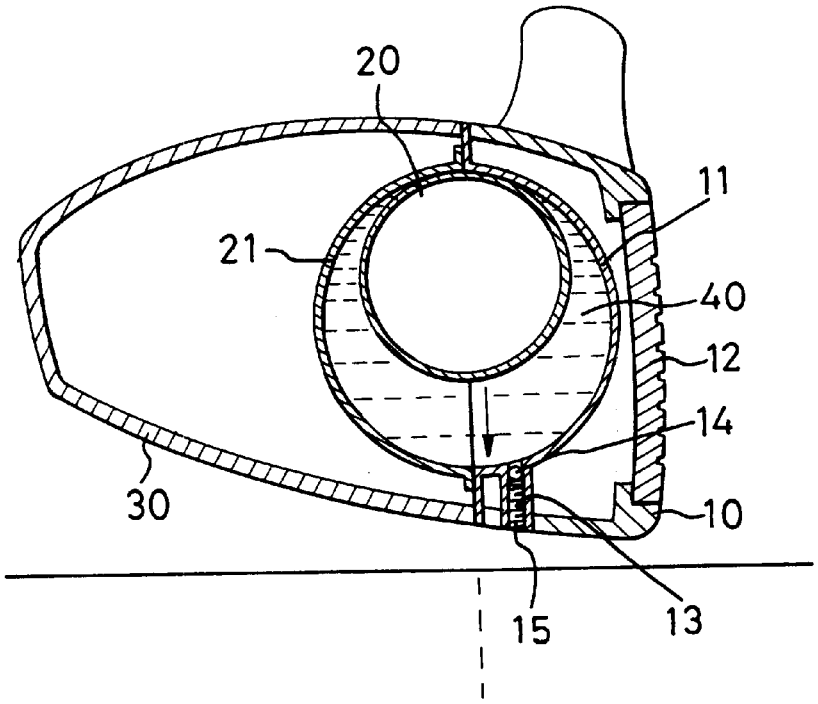
FIG. 5 is a cross sectional view of the assembled head portion of the golf club shown in a second inclination.
Figure 6:
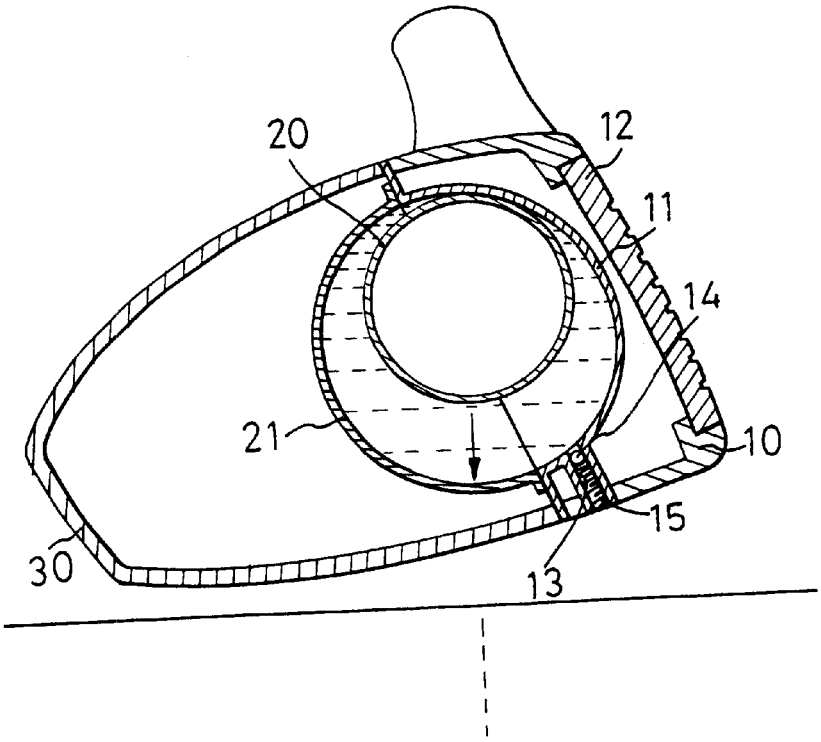
FIG. 6 is cross sectional view of the assembled head portion of the golf club shown in a third inclination.

Now referring to FIG. 3, a space between the float (20) and the combined first and second semi-spheres (11, 21) is filled with a liquid (40). As best seen in FIGS. 4 to 6, a filling line (13) is formed between the first semi-sphere (11) and the bottom of the body portion (10). The filling line (13) defines a threaded hole with a narrow neck portion at an end communicating with the space of the combined first and second semi-spheres (11, 21), and an opposite end communicating with the exterior of the club head. The neck portion has a concave outer face. A steel ball (14) has a diameter smaller than the diameter of the threaded hole and greater than the narrow neck portion. After the liquid (40) is poured in the space between the two semi-spheres (11, 21) and the float (20), the steel ball (14) is placed into the filling line (13) and mates with the concave outer face of the neck portion, and then a screw (15) is threadingly engaged with the threaded hole of the filling line (13) to retain the steel ball (14) in position, whereby the threaded hole of the filling line (13) is sealed.

As the specific gravity of the float (20) is far higher than that of the liquid (40), the float (20) always floats at a high level, and the liquid (40) is always low, so that the center of mass of the head of the golf club is lower. As the liquid is fluid, the center of mass of the golf club is changeable and always occurs at the lowest possible point.

The invention has the following advantages:

1. the structure of the head of the golf club of present invention is simple and firm, and the production cost is low;
2. the head of the golf club comprises the float (20) received in the combined two semi-sphere (11, 21) with the liquid (40) occupying the space therebetween; whereby the center of mass of the golf club is self-optimizing; and
3. as the head of the golf club is hollow, it strikes the golf ball with a preferred audible "crack".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A head of golf club comprising a hollow body with a first semi-sphere integrally formed therein and a face securely attached on a front end thereof, a float received in a space defined between the first semi-sphere and a second semi-sphere which is securely attached with the first semi-sphere, and a casing securely attached on a back end of the body portion; wherein a filling line extends between the space of the combined first and second semi-spheres and an exterior of the body portion for receiving a liquid poured into the head;

a ball for leak-proofing the golf club head is provided in the filling line after the filling of the combined semi-spheres with the liquid, wherein a screw is threadingly engaged with the filling line to seal the filling line.

2. The head of golf club as claimed in claim 1, wherein the filling line has a threaded portion in communication with an exterior thereof and with a diameter greater than a diameter of the ball, and a narrow neck portion with an outer face contoured to mate with and smaller than the diameter of the ball and in communication with the space between the combined semi-spheres.

* * * * *